US009657425B2

(12) United States Patent
Park et al.

(10) Patent No.: US 9,657,425 B2
(45) Date of Patent: May 23, 2017

(54) WASHING MACHINE AND A METHOD FOR CONTROLLING THE SAME

(71) Applicant: LG Electronics Inc., Seoul (KR)

(72) Inventors: Eun Jin Park, Gyeongsangnam-do (KR); Deug Hee Lee, Gyeongsangnam-do (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/802,869

(22) Filed: Jul. 17, 2015

(65) Prior Publication Data

US 2015/0322612 A1 Nov. 12, 2015

Related U.S. Application Data

(63) Continuation of application No. 12/345,865, filed on Dec. 30, 2008, now Pat. No. 9,115,453.

(30) Foreign Application Priority Data

Dec. 31, 2007 (KR) ..... 10-2007-0141559

(51) Int. Cl.
*D06F 35/00* (2006.01)
*D06F 39/08* (2006.01)
(Continued)

(52) U.S. Cl.
CPC ..... *D06F 35/005* (2013.01); *D06F 33/02* (2013.01); *D06F 35/00* (2013.01); *D06F 39/00* (2013.01);
(Continued)

(58) Field of Classification Search
CPC .... D06F 35/005; D06F 35/007; D06F 35/008; D06F 39/08; D06F 33/02; D06F 2232/08;
(Continued)

(56) References Cited

U.S. PATENT DOCUMENTS

| | | | | |
|---|---|---|---|---|
| 3,006,176 | A | 10/1961 | Behrens | |
| 3,269,153 | A | 8/1966 | Waldrop | |
| 5,285,664 | A | 2/1994 | Chang et al. | |
| 5,768,730 | A * | 6/1998 | Matsumoto | D06F 25/00 210/144 |
| 6,691,359 | B2 | 2/2004 | Park et al. | |
| 2007/0094811 | A1 | 5/2007 | Sechelmann | |

FOREIGN PATENT DOCUMENTS

| | | |
|---|---|---|
| CN | 1611661 A | 5/2005 |
| CN | 1616743 A | 5/2005 |

(Continued)

OTHER PUBLICATIONS

Machine Translation of Matsumoto, JP 2006-314428, Nov. 2006.

*Primary Examiner* — David Cormier
(74) *Attorney, Agent, or Firm* — Birch, Stewart, Kolasch & Birch, LLP

(57) ABSTRACT

The present invention relates a washing machine and a method for controlling the same. The method for controlling a washing machine, having at least one spinning course, the spinning course includes a general spinning step for driving a motor which rotates a drum rotatably mounted in a tub to rotate the drum at a speed higher than a predetermined speed for extracting water, and a foreign matter removal step for supplying water to the tub for removing foreign matters from a space between the tub and the drum, whereby permitting to maintain the washing machine clean.

8 Claims, 2 Drawing Sheets

(51) Int. Cl.
*D06F 33/02* (2006.01)
*D06F 39/00* (2006.01)

(52) U.S. Cl.
CPC ..... *D06F 39/08* (2013.01); *D06F 2202/12* (2013.01); *D06F 2204/06* (2013.01); *D06F 2204/084* (2013.01); *D06F 2204/086* (2013.01); *D06F 2220/00* (2013.01); *D06F 2232/08* (2013.01)

(58) Field of Classification Search
CPC ..... D06F 2204/06; D06F 2204/084; D06F 2204/086; D06F 2204/088
See application file for complete search history.

(56) References Cited

FOREIGN PATENT DOCUMENTS

| | | | |
|---|---|---|---|
| DE | 103 28 071 | A1 | 1/2005 |
| EP | 1 365 057 | A1 | 11/2003 |
| EP | 1 681 384 | A1 | 7/2006 |
| JP | 2-255179 | A | 10/1990 |
| JP | 2006-314428 | A | 11/2006 |
| KR | 10-2000-0033339 | A | 6/2000 |
| KR | 10-2004-0045115 | A | 6/2004 |
| KR | 10-2005-0110152 | A | 11/2005 |
| KR | 10-0531335 | B1 | 11/2005 |
| KR | 10-0645651 | B1 | 11/2006 |
| WO | WO 2007/073012 | A1 | 6/2007 |
| WO | WO 2007/073013 | A1 | 6/2007 |

* cited by examiner

WASHING MACHINE AND A METHOD FOR CONTROLLING THE SAME

CROSS-REFERENCE TO RELATED APPLICATIONS

This application is a divisional of co-pending U.S. patent application Ser. No. 12/345,865 filed on Dec. 30, 2008, which claims the benefit of the Patent Korean Application No. 10-2007-0141559, filed on Dec. 31, 2007, which is hereby incorporated by reference as if fully set forth herein.

BACKGROUND OF THE INVENTION

Field of the Invention

The present invention relates to washing machines, and more particularly, to a washing machine and a method for controlling the same.

Discussion of the Related Art

In general, the washing machine is a home appliance for removing foreign matters from clothes. The washing machine has a washing course, a rinsing course, and a spinning course for washing laundry such as the clothes.

Recently, front loading type washing machines are used widely, in which the laundry is introduced to the washing machine through a front thereof. In the meantime, in a related art, as the washing machine is used longer, the accumulated foreign matters are increasingly formed, which makes a washing effect poor.

As an example, in a case of the front loading type, the front loading type washing machine is provided with a tub for holding washing water, a drum rotatably mounted in the tub for holding the laundry, and pass through holes in the drum for movement of the washing machine.

Accordingly, if the washing, rinsing, and spinning courses are progressed, in which the drum is rotated, or pulsated, because the foreign matters separated from the laundry escape the drum through the pass through holes in the drum and accumulate on an inside wall of the tub, or are stuck to the pass through holes in communication with an outside wall of the drum, as the washing machine is used the longer, the foreign matters accumulate in a space between the tub and the drum.

The foreign matters accumulated and stuck to the outside wall of the drum or the inside wall of the tub, not only make the washing effect poor significantly, but also, if intensive, cause fungi and the like to grow in the space between the tub and the drum and contaminate the laundry, leading to cause skin trouble when the user puts on the clothes.

SUMMARY OF THE INVENTION

Accordingly, the present invention is directed to a washing machine and a method for controlling the same.

An object of the present invention is to provide a washing machine and a method for controlling the same, which can remove foreign matters accumulated from a space between a drum and a tub, effectively.

Another object of the present invention is to provide a washing machine and a method for controlling the same, which can remove foreign matters accumulated from a space between a drum and a tub while power consumption is minimized.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for controlling a washing machine, having at least one spinning course, the spinning course includes a general spinning step for driving a motor which rotates a drum rotatably mounted in a tub to rotate the drum at a speed higher than a predetermined speed for extracting water, and a foreign matter removal step for supplying water to the tub for removing foreign matters from a space between the tub and the drum.

The foreign matter removal step is performed when the motor is turned off and the drum rotates by inertia force.

The foreign matter removal step includes the step of supplying the water for removal of the foreign matters at the same time with turning off of the motor.

The foreign matter removal step includes the step of supplying the water for removal of the foreign matters after a predetermined time period is passed from turning off of the motor.

The foreign matter removal step includes the step of removing the foreign matters from an inside wall of the tub or an outside wall of the drum.

The method further includes a signal applying step for enabling a user to select whether the foreign matter removal step is performed or not before finishing the general spinning step.

The spinning course is included to a washing course or a rinsing course of the washing machine at least once.

In another aspect of the present invention, a washing machine includes a tub in a cabinet for holding washing water, a drum rotatably mounted in the tub, a water supply portion for supplying water to a space between the tub and the drum for removal of foreign matters, and a control unit for controlling opening/closing of the water supply portion.

The control unit controls the water supply portion such that the water can be supplied between the tub and the drum for removing the foreign matters in a spinning course for spinning laundry.

The washing machine further includes a foreign matter removing button for selection of operation of the water supply portion for the user to remove the foreign matters as the user likes.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
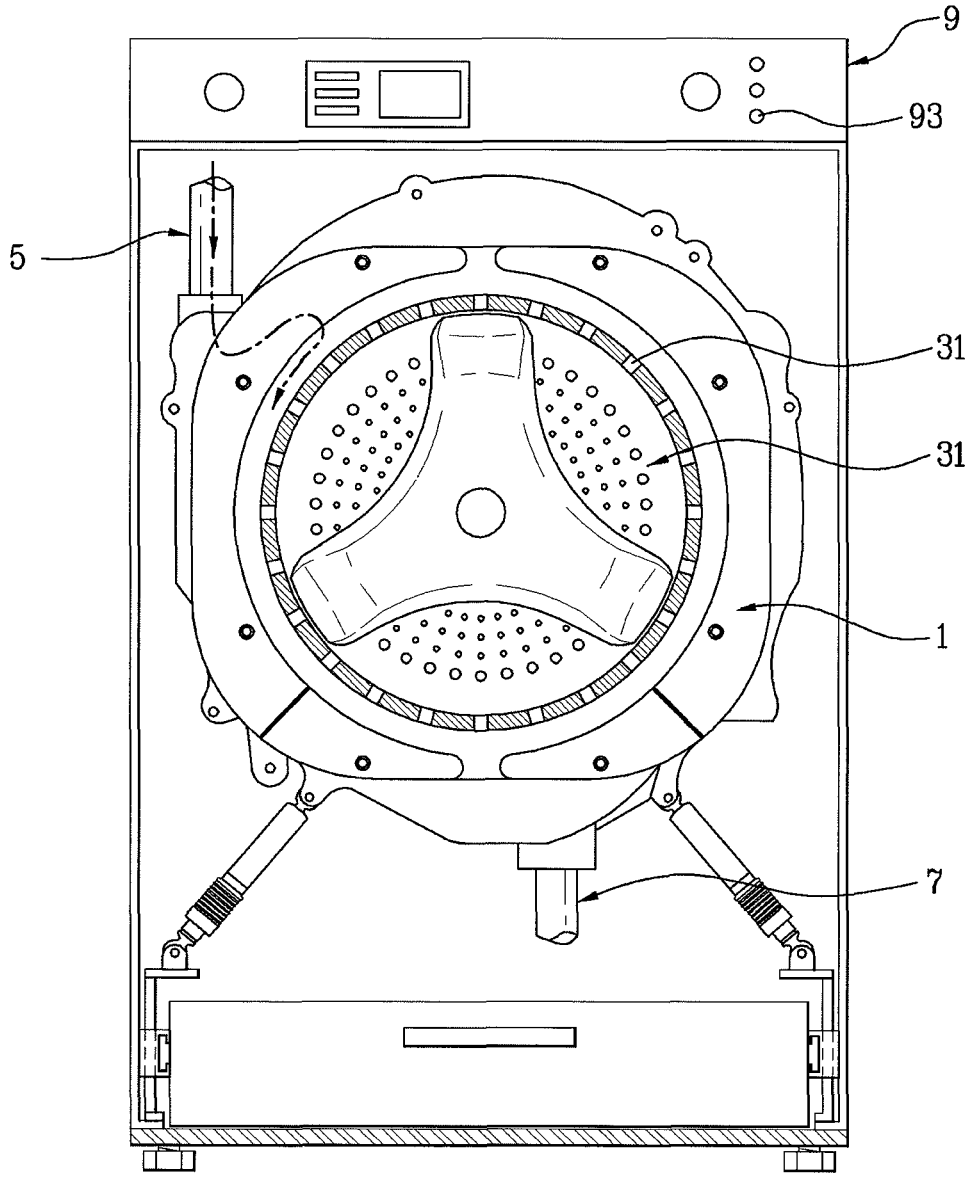
FIG. 1 illustrates a conceptual drawing of a washing machine in accordance with a preferred embodiment of the present invention.

FIG. 1 illustrates a conceptual drawing of a washing machine in accordance with a preferred embodiment of the present invention. The washing machine in accordance with a preferred embodiment of the present invention with reference to FIG. 1.

Referring to FIG. 1, the washing machine includes a tub 1, a drum 3 rotatably mounted in the tub 1, a water supply portion 5 at one side of the tub 1 for supplying water to remove foreign matters, a drain portion 7 at the other side of the tub 1 for draining the water supplied through the water supply portion 5, and a control panel 9 for controlling the water supply portion 5 and the drain portion 7.

The drum 3 is rotatably mounted in the tub 1 and receives rotating power from a motor (not shown) coupled to the drum 3.

The drum 3 has a plurality of pass through holes 31 which pass through the drum. The pass through holes 31 serve the washing water held in the tub 1 to move into the drum 3, and enable the washing water to escape from the laundry when the drum 3 rotates.

The water supply portion 5 is at one side of the tub 1 for supplying the water to a space between the tub 1 and the drum 3. Therefore, it is preferable that the water supply portion 5 has one side connected to a hose (not shown) for supplying the washing water to the washing machine, and the other side connected to the tub 1. There may be a passage (not shown) for the water from the water supply portion 5 to pass through the tub 1.

The drain portion 7 may be at one side of the tub 1 for draining the water having supplied from the water supply portion 5 and removed the foreign matter.

The control panel 9 mounted to the washing machine for controlling operation of the drum 3, the water supply portion 5 and the drain portion 7. The control panel includes a control unit 91 (See FIG. 2) for controlling operation of the drum 3, the water supply portion 5 and the drain portion 7, and may include a foreign matter removal button 93 for providing a signal for carrying of a foreign matter removal step which will be described, later. Therefore, if the user presses the foreign matter removal button 93 at the time the user determines that removal of the foreign matter is required, the foreign matter removal step (will be described in detail later) is added to the washing courses, thereby removing the foreign matters from a space between the tub and the drum as the user likes.

However, since the foreign matter removal button 93 is required in a case the washing machine of the present invention performs the foreign matter removal step according to user's operation, if a washing machine is provided, which performs the foreign matter removal step automatically without a user's order, the foreign matter removal button 93 is not essential.

For an example, if it is set in advance that the washing machine having the washing course, the rinsing course, and the spinning course performs the foreign matter removal step in the spinning course every time a total number of times in which the courses are performed exceeds 10, the washing machine will not require mounting of the foreign matter removal button 93, necessarily.

Figure 2:
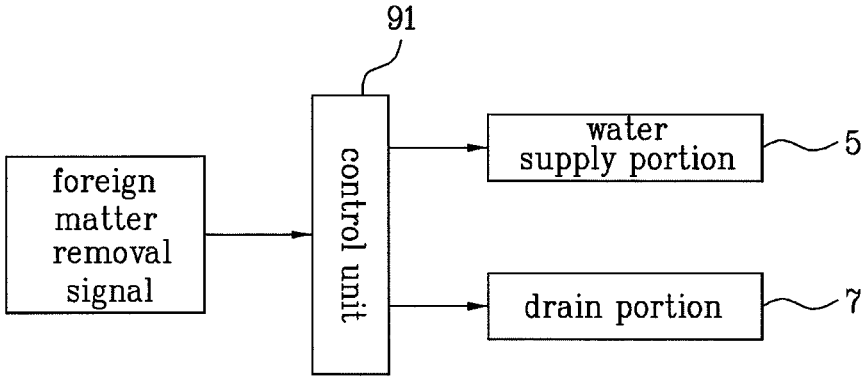
FIG. 2 illustrates a block diagram of a control unit in a washing machine in accordance with a preferred embodiment of the present invention.

FIG. 2 illustrates a block diagram of a control unit in a washing machine in accordance with a preferred embodiment of the present invention. Referring to FIG. 2, the control unit 91 receives the foreign matter removal signal. The foreign matter removal signal may be provided by pressing the foreign matter removal button 93, or the washing machine may be set such that the foreign matter removal signal is provided at the same time with finish of the spinning step.

Upon reception of the foreign matter removal signal, the control unit 91 controls the water supply portion 5 such that the water can be supplied to a space between the drum 3 and the tub 1 through the water supply portion 5. In more detail, the control unit 91 can open/close the water supply portion 5 for supply the water to the water supply portion 5, and can control an open time period of the water supply portion 5 or an opened size of a flow passage of the water supply portion for controlling a flow rate of the water being supplied through the water supply portion 5.

In the meantime, if it is determined that removal of the foreign matters is finished by the water supplied through the water supply portion 5, the control unit 91 controls such that the water used for removal of the foreign matters is drained through the drain portion 7.

Figure 3:
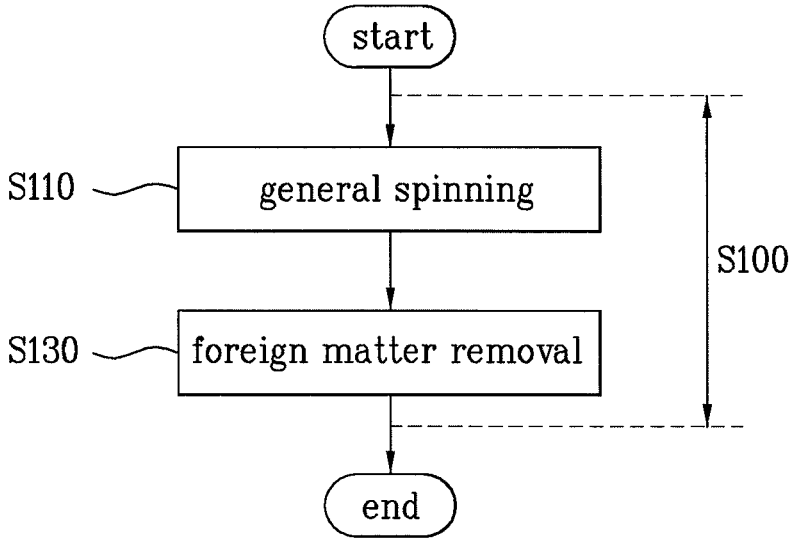
FIG. 3 illustrates a flow chart showing the steps of a method for controlling a washing machine in accordance with a preferred embodiment of the present invention.

FIG. 3 illustrates a flow chart showing the steps of a method for controlling a washing machine in accordance with a preferred embodiment of the present invention. The method for controlling a washing machine in accordance with a preferred embodiment of the present invention will be described with reference to FIG. 3. Referring to FIG. 3, a spinning course S100 in accordance with a preferred embodiment of the present invention includes a general spinning course S110, and a foreign matter removal step S130 for removal of foreign matters from a space between the tub and the drum.

The spinning course is a step in which the washing water is removed from the laundry upon finishing washing and rinsing of the laundry. However, depending on cases, since there can be a case when it is required to remove the washing water from the laundry in a process the washing course and the rinsing course are progressed, it is required to take a step for extracting the washing water from the laundry in the washing and rinsing courses is also included to the spinning course the present invention describes.

The general spinning step S110 is a step for removing water from the laundry. In this case, the motor is driven to rotate the drum at a speed faster than a preset speed for removal of the water from the laundry. However, if the washing machine is used repeatedly, the foreign matters discharged in the washing course, rinsing course, and the spinning course accumulate in the space between the tub and the drum. Particularly, the foreign matters stick to an inside of the tub or an outside of the drum, and, if intensive, cause fungi or the like to grow.

Accordingly, it is preferable that the spinning course S100 of the embodiment further includes the foreign matter removal step S130 for removing the foreign matters from the outside or the drum or the inside of the tub.

The foreign matter removal step S130 is a step for removing the foreign matters from the outside of the drum and the inside of the tub by supplying water between the tub and the drum.

The foreign matter removal step S130 is performed in succession to the general spinning step S110 because power enough to remove the foreign matters from the drum can be obtained without applying a special pressure to the water being supplied through the water supply portion 5 (See FIG. 1) owing to a rotation speed of the drum which is the highest in the general spinning step, moreover, the high rotation speed of the drum supplies power to the water being supplied from the water supply portion for removing the foreign matters from the tub while the water moves between the inside surface of the tub and the outside surface of the drum by a rotating force of the speed.

In the meantime, in order to make easy removal of the foreign matters from the outside surface of the drum and the inside surface of the tub, the foreign matter removal step S130 may be performed by a system in which the water from the water supply portion 5 (See FIG. 1) is sprayed to the outside surface of the drum or the inside surface of the tub, directly.

Therefore, a discharge end of the water supply portion 5 through which the water is discharged from the water supply portion 5 may be mounted such that the discharge end is positioned in a space between the drum and the tub, while the discharge end does not interfere the rotation of the drum.

Or, the foreign matter removal step S130 may be performed by a system in which the water from the water supply portion 5 (See FIG. 1) rotates along the space between the drum 3 and the tub 1 by the rotation force of the drum 3 to remove the foreign matters from the space.

It is liable that the water can be supplied to the laundry again if a large quantity of water is supplied in the foreign matter removal step S130, it is required to control the water supply quantity, appropriately.

That is, since the foreign matter removal step S130 is performed after the general spinning step in the embodiment of the present invention, if the water supply quantity is large excessively, to supply the water to the laundry having the water removed therefrom again, spinning efficiency may be poor. Therefore, it is preferable that the water supply quantity in the foreign matter removal step S130 is a quantity which is required minimum for removal of the foreign matters so that the laundry is not wet, again.

In the meantime, because the motor consumes power if the drum is rotated additionally for removal of the foreign matters from the space between drum 3 and the tub 1, it is preferable that the foreign matter removal step S130 in the embodiment of the present invention is performed when the motor is turned off in the general spinning step S110.

That is, in a case the motor runs in the general spinning step S110, the drum is rotated to perform the spinning, and even if the motor is turned off, the drum stops, not right away, but keeps rotating for a certain time period by inertia. According to this, the foreign matter removal step of the embodiment is performed by supplying the water in a case the motor is turned off, leaving the drum to rotate by the inertia. In this case, though the water may be supplied after a predetermined time period, for an example, about 5 seconds, is passed from the turning off of the motor, it is preferable that the water is supplied for a predetermined time period, for an example, 5 to 20 seconds, starting right after the turning off of the motor. This is because the water supply starting from right after the turning off of the motor is favorable in view of removal of the foreign matters by using the water being supplied, since the rotation speed of the drum slows down gradually if the motor is turned off. Moreover, the highest rotation speed of the drum at the time the motor is turned off, not only is favorable for removing the foreign matters, but also enables to prevent the laundry from being wet by the water supplied from the water supply portion.

Eventually, it is possible that the foreign matter removal step enables to prevent the laundry from being wet by the water again, and to remove the foreign matters from between the drum and the tub.

In the meantime, the method for controlling a washing machine of the present invention may include a signal applying step (not shown) for enabling a user to select whether the foreign matter removal step S130 is performed or not by means of the foreign matter removal button 93 (See FIG. 1), additionally. The signal applying step (not shown) may be performed before starting, or during the spinning course S100. However, it is preferable that the signal applying step is performed at least before finish of the general spinning step.

Accordingly, if the user presses the foreign matter removal button 93 after finishing the washing course, the rinsing course, the washing machine performs the foreign matter removal step after finishing the general spinning step in the spinning course S100. In the meantime, if the user presses the foreign matter removal button any time before finishing the general spinning step, the washing machine of the present invention can perform the foreign matter removal step S130 after finishing the general spinning step.

The operation and control method of the washing machine for removal of the foreign matters from the space between the drum and the tub will be described with reference to FIGS. 1 and 3. Meanwhile, as a case when the foreign matter removal step is performed by the user's selection has been described already, a case when the foreign matter removal step is performed even if there is no user's selection will be described.

When the washing machine performs the spinning course, the drum rotates in one direction. In this instance, the laundry in the drum 3 rotates with the drum 3 in a state the laundry is in close contact with the outside surface of the drum 3. According to this, the water extraction progresses as the washing water is discharged from the laundry to an outside of the drum through the pass through holes in the drum. However, in the step of progressing the spinning course, the foreign matters contained in the laundry passes through the pass through holes together with the washing water and accumulate on the outside surface of the drum 3 or the inside surface of the tub 1.

In the meantime, since the water supply portion 5 is mounted at one side of the tub 1 for supplying the water between the tub 1 and the drum 3, if the water supply portion 5 supplies the water during the drum 1 progresses the spinning course, the water can remove the foreign matters from the outside surface of the drum 1. Particularly, the control unit 91 controls opening/closing of the water supply portion 5 and an extent of the opening/closing of the water supply portion 5 (control of a water flow rate being supplied).

However, the foreign matter removal signal may be applied by pressing the foreign matter removal button 9 (See FIG. 1), or automatically according to conditions set to the washing machine.

The 'set conditions' may be, for an example, a case the foreign matter removal signal is always applied in a case the general spinning step is finished. The 'set conditions' may be, for an example, a case the foreign matter removal signal is always applied in a case a total number of times in which the courses of the washing course, the rinsing course, and the spinning course are performed exceeds a preset number of times.

In the meantime, it is preferable that the water supply portion supplies the water during rotation of the drum by the inertia force after the motor which runs the drum 3 is turned off. Even if the motor is turned off, the drum 3 can rotate for a certain time period by the inertia. Therefore, if the water is supplied between the tub 1 and the drum 3 rotating by the inertia force through the water supply portion, enabling to remove the foreign matters without running the drum additionally for removal of the foreign matters, no additional power is required.

The water which removes the foreign matters from the outside surface of the drum 3 and the inside surface of the tub 1 is discharged through the drain portion 7 on the other side of the tub 1, thereby permitting to maintain the space between the tub 1 and the drum 3 cleanly. In this instance, the control unit 91 controls opening/closing of the drain portion 7.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A washing machine comprising:

a tub in a cabinet for holding washing water;

a drum rotatably mounted in the tub;

a motor to rotate the drum;

a water supply portion for supplying water to a space between the tub and the drum for removal of foreign matters; and a control unit configured to control opening/closing of the water supply portion, wherein the water supply portion supplies water to the space between the tub and the drum when the motor is turned off and the drum rotates by inertia force for removal of foreign matters from the space between the tub and the drum, and wherein the control unit is further configured to perform a spinning course, the spinning course including:

performing a general spinning step for driving the motor which rotates the drum at a speed higher than a predetermined speed for extracting water from laundry, turning off the motor such that the drum rotates by inertia force, immediately after the general spinning step has been performed for a predetermined time, supplying a predetermined amount of water directly to an outside surface of the drum or an inside surface of the tub during a rotation of the drum, and rotating the supplied water along the space between the drum and the tub by a rotational force of the drum to remove the foreign matters from the inside surface of the tub and the outside surface of the drum, wherein the step of supplying the predetermined amount of water is performed simultaneously with the step of turning off the motor.

2. The washing machine as claimed in claim 1, wherein the control unit controls the water supply portion such that the water can be supplied between the tub and the drum for removing the foreign matters in a spinning course for spinning laundry.

3. The washing machine as claimed in claim 1, further comprising a foreign matter removing button for selection of operation of the water supply portion for a user to remove the foreign matters as the user likes.

4. The washing machine as claimed in claim 1, wherein the spinning course further comprises performing a signal applying step for enabling a user to select whether a set of the steps of turning off the motor and supplying the predetermined amount of water, and rotating the supplied water, are performed or not before finishing the general spinning step.

5. The washing machine as claimed in claim 1, wherein the spinning course is included to a washing course or a rinsing course of the washing machine at least once.

6. The washing machine as claimed in claim 1, wherein the steps of turning off the motor, supplying the predetermined amount of water, and rotating the supplied water are automatically performed in sequence when a total number of performed washing courses, rinsing courses, and spinning courses exceeds a preset number of times.

7. The washing machine as claimed in claim 1, wherein the water supply portion is mounted at one side of the tub for supplying the water between the tub and the drum.

8. The washing machine as claimed in claim 1, further comprising:

a drain portion at a side of the tub for draining the water supplied through the water supply portion.

* * * * *